US006110048A

United States Patent [19]

Murray

[11] Patent Number: 6,110,048

[45] Date of Patent: Aug. 29, 2000

[54] LOOP SWING APPARATUS

[75] Inventor: Robert H. Murray, Palm Beach Gardens, Fla.

[73] Assignee: Hang Time Inc., Palm Beach Gardens, Fla.

[21] Appl. No.: 09/121,696

[22] Filed: Jul. 24, 1998

[51] Int. Cl.[7] ..... A63G 1/20

[52] U.S. Cl. ..... 472/16; 472/118

[58] Field of Search ..... 472/118, 119, 472/14, 16, 3, 44, 131; 434/29, 55, 30, 34

[56] References Cited

U.S. PATENT DOCUMENTS 3,053,535 9/1962 Gabrielson .
3,207,508 9/1965 Klemke .
3,276,777 10/1966 Pruitt, Sr. .
3,972,527 8/1976 Bacon ..... 472/16
4,036,489 7/1977 Potyondy .
4,113,250 9/1978 Davis ..... 472/14
4,228,999 10/1980 Armstrong .
5,707,295 1/1998 Shingledecker .

*Primary Examiner*—Kien T. Nguyen
*Attorney, Agent, or Firm*—Tipton L. Randall

[57] ABSTRACT

The invention is a portable swing apparatus having triangular support frame members with a top horizontal bar that provides a rotary axis for a swing assembly that carries a rider. The swing has two bar members extending from the horizontal bar to each side of a foot rest with a counter weight extending in opposition to the foot rest, above the horizontal bar. The rider stands on the foot rest, with feet fastened thereto, and is enclosed in an upper-body safety bracket. A safety belt restraint is also provided. The rider pumps the swing and can safely perform front and back loops in a standing position. The device is adjustable to accommodate various sized riders.

20 Claims, 6 Drawing Sheets

LOOP SWING APPARATUS

FIELD OF THE INVENTION

The invention relates to a loop swing and, more particularly, to a portable loop swing apparatus.

BACKGROUND OF THE INVENTION

Swings for exercise or amusement have been know to man since ancient times. The earliest swing was likely a climbing vine suspended from a tree. In the recent past, swings were fashioned from ropes, metal cable or chain, and the like. The most common configuration for a swing is a seat platform suspended above the ground by a pair of ropes or chains hanging down from an overhead support structure, such as a tree or constructed frame. The rider sits or stands on the seat platform and induces the swing to move to and fro by rhythmic body movements commonly termed "pumping".

Many instances of injury have occurred to individual riders on a swing. Children, who most often are the swing riders, are common injury victims. Other individual who are in the vicinity of the swing are subject to injury if they inadvertently enter the path of the swinging individual.

A number of innovations have been developed relating to swings or similar amusement devices. The following U. S. patents are representative of some of those innovations.

Gabrielson, in U.S. Pat. No. 3,053,535, discloses a spring suspended frame that holds a standing rider.

A playground swing that holds two riders in an upright position is shown by Grudoski in U. S. Pat. No. 3,145,013.

Klemke, in U.S. Pat. No. 3,207,508, discloses a revolving and translating aerial trapeze with a cage surrounding the rider.

In U.S. Pat. No. 3,276,777 Pruitt, Sr., shows an occupant-propelled plural axis roundabout device with a safety belt for the rider.

U.S. Pat. No. 4,036,489 by Potyondy discloses a swing device that has a seat with a safety belt to hold a seated rider, thus allowing the rider to swing in a 360 degree arc.

A somersault swing that moves along the ground is disclosed by Armstrong in U.S. Pat. No. 4,228,999.

Shingledecker, in U.S. Pat. No. 5,707,295, discloses a swing device that holds the rider in a prone position relative to the ground.

Thus, there is an unmet need for a swing apparatus on which an individual can ride without fear of injury. There is also a need to prevent bystanders from being injured by the device while the rider is operating the swing apparatus.

SUMMARY OF THE INVENTION

The invention is a portable swing apparatus for allowing an individual to safely perform forward or backward loops while in a standing position. The apparatus comprises a horizontal flat base member having top and bottom sides. First and second pairs of K-shaped leg support members are each connected at one end to an overhead spreader bar assembly and at an opposite end to spaced apart locations on the base member top side to form triangular support frame structures. The triangular support frame structures are positioned near opposite edges of the base member. A top horizontal bar member is rotatably attached between the overhead spreader bar assemblies of the triangular support frame structures, with the top bar member rotating within bearing members contained in each overhead spreader bar assembly. A rider carrying swing assembly is positioned between the triangular support frame structures. The swing assembly comprises a pair of linear swing bar members rigidly attached to the top horizontal bar member, with each swing bar member having a top portion extending a selected distance above the bar member and a bottom portion extending a selected distance below the bar member. A horizontal foot support assembly is secured at each end to the swing bar members bottom end and positioned there between and a selected distance above the base member and adapted to securely fasten a rider's feet thereto. A rider encircling bracket member is positioned between the swing bar members and is attached thereto, with the encircling bracket member located a selected distance above the foot support member. A counter weight assembly member is positioned between the swing bar member top portions and attached there between.

A rider, in a standing position with feet secured by the foot support assembly and torso encircled by the encircling bracket member, causes the swing assembly to move to and fro by rhythmic body movements thereby causing the swing assembly with the rider thereon to loop around the rotatable horizontal bar member.

DESCRIPTION OF THE PREFERRED EMBODIMENTS

Nomenclature

10 Loop Swing Apparatus
20 Flat Base Support Member
22 Top Side of Base Support Member
24 Bottom Side of Base Support Member
26 Skid Members of Base Support
27 Wheeled Axle Frame with Hitch Means
28 Adjustable Jack Member
29 Set of Steps
30 K-shaped Leg Support Members
32 Top End of Leg Support Member
33 Bottom End of Leg Support Member
35 Overhead Spreader Bar Assembly
37 Overhead Bracket Member
38 Hollow Tubular Member of Spreader Bar
40 Triangular Support Frame Structure
45 Top Horizontal Bar Member
47 Rectangular Center Section of Top Bar Member
50 Bearing Members of Spreader Bar Assembly
60 Rider Carrying Swing Assembly
62 Linear Swing Bar Members
64 Top Portion of Swing Bar Members
66 Bottom Portion of Swing Bar Members
70 Horizontal Foot Support Assembly
80 Rider Encircling Bracket Member
82 Tubular Vertical Sections of Bracket Member

Figure 1:
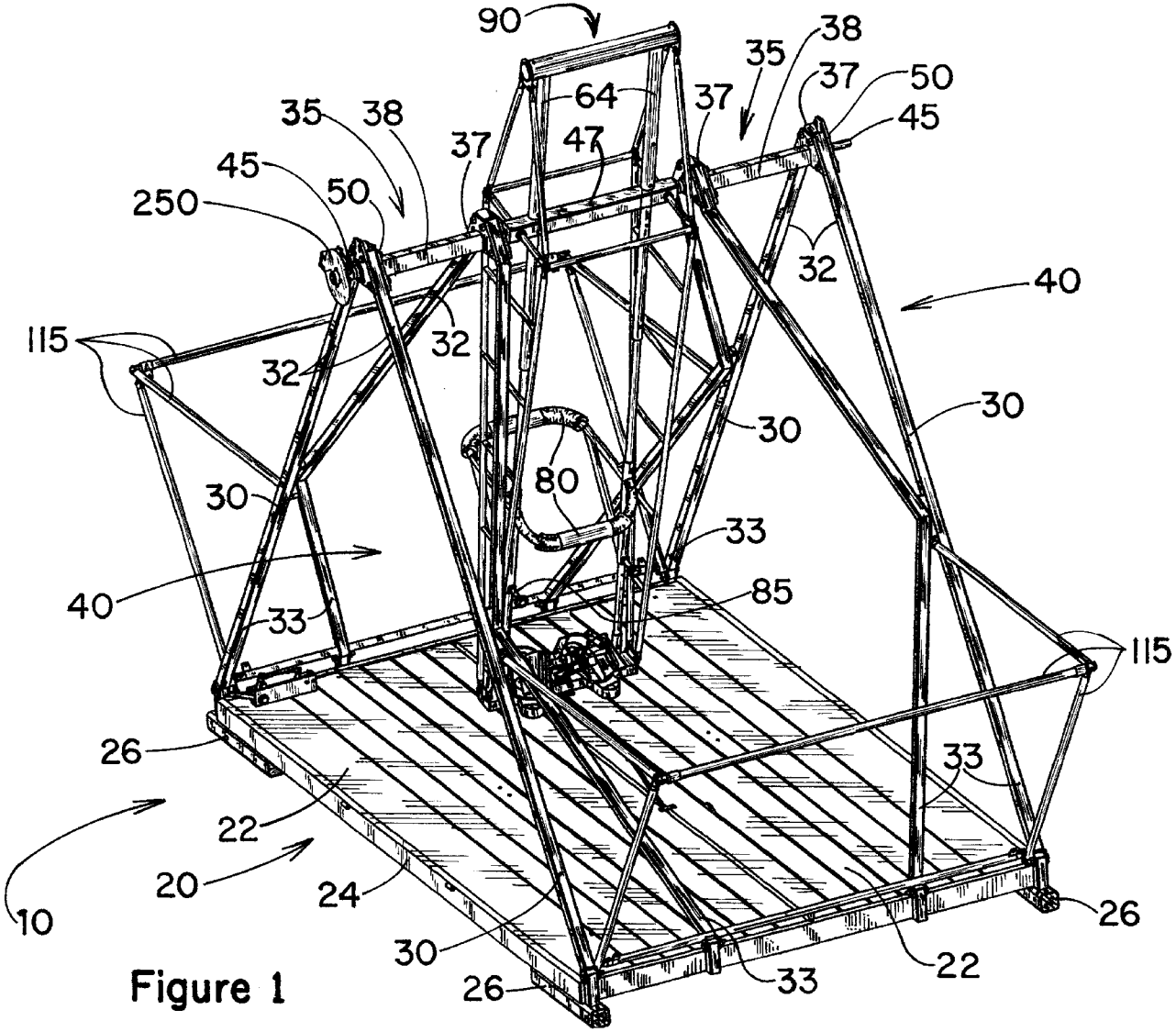
FIG. 1 is a perspective view of the swing apparatus of the present invention.

85 Pull Pin Handle Member
87 Apertures in Swing Bar Members
90 Counter Weight Assembly Member
92 Outer Cylindrical Member of Counter Weight
94 Solid Cylindrical Weight Member
115 Safety Railings
120 Stability Bracing Members
125 Vertical Stability Bracing Members
130 Horizontal Stability Bracing Members
140 Horizontal Cross Member
142 Tubular Connector Members
145 Molded Foot Plate
150 Brace Member
170 Top Foot Clamp Assembly
175 Anchor Bar Member
180 Traveling Bracket Member
185 Stop Block Member
190 Top Foot Clamp Members
195 Round Bar Member
200 Threaded Bar Member
205 Threaded Aperture in Stop Block
210 Handle Member for Threaded Bar
215 Eye Bolts
217 Cable of Short Length
220 Safety Belt Assembly
225 Flexible Belt Member
230 Belt Fastener Member
235 Belt Padding Material
240 D-Ring Connectors
242 Safety Snap Hooks
245 Anchor Hook Member
250 Braking Device for Swing Assembly Construction Referring to FIG. 1, the portable loop swing apparatus 10 of the present invention is shown. The apparatus 10 includes a horizontal, flat base member 20 having a top side 22 and a bottom side 24. The base member is generally rectangular in shape and has support skids 26 fastened at the comers on the bottom side 24 of the base member 20. The support skids 26 are aligned parallel on opposite sides of the base member 20 to allow the swing apparatus 10 to be easily moved from one location to another. The base member 20 may be constructed of wood, metal or synthetic material by conventional construction methods. It is preferred that the base member 20 be made from extruded board-like components fabricated from recycled plastic material. These plastic components are fabricated to be resistant to weathering and economically competitive with wood lumber. The base member 20 is designed to provide a strong, stable mounting platform for the other components of the swing apparatus.

Figure 1A:
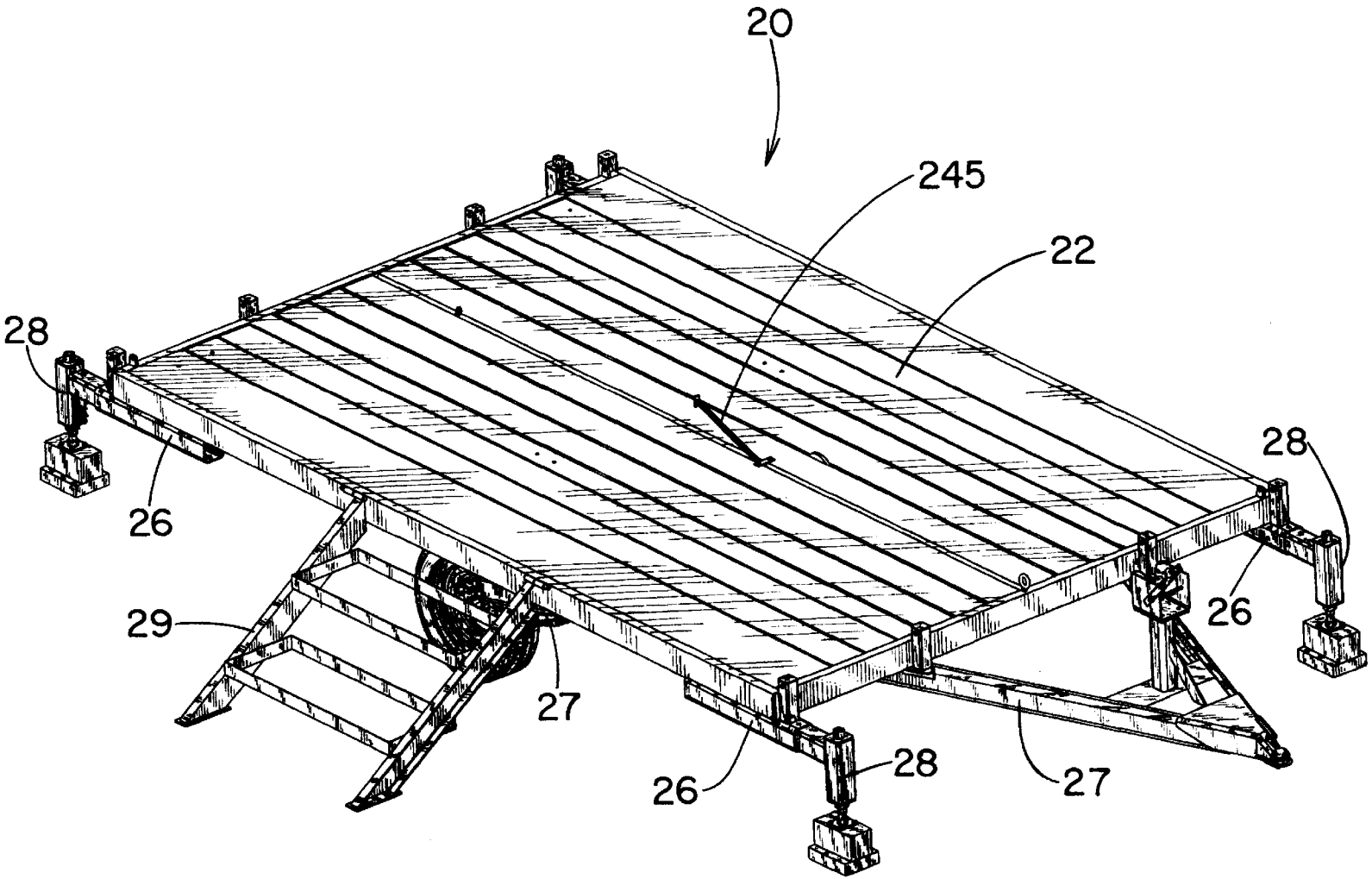
FIG. 1A is a perspective view of a further embodiment of the base support member.

In a further embodiment of the invention shown in FIG. 1A, the flat base support member 20 is mounted on a wheeled axle frame with hitch means 27 for connection to a transport vehicle. The support skid members 26 positioned at the four corners of the base support member 20 have the capacity to receive an adjustable jack member 28. To anchor the base support member 20, each jack member 28 is extended to securely contact the ground, thereby providing a level, supported base member 20 for the remainder of the swing apparatus 10. A small set of steps 29 may be attached to the base member 20 to assist in accessing the top side 22 of the base support member 20.

Again referring to FIG. 1, two K-shaped leg support members 30 are each connected at one top end 32 to an overhead spreader bar assembly 35 such that there is an oblique angle of about sixty degrees between the support members 30. The overhead spreader bar assembly 35 includes a pair of bracket members 37 secured to each end of a hollow tubular member 38. Each leg end 32 of the K-shaped leg support members 30 is secured to one bracket member 37 of the spreader bar assembly 35. The opposite lower end 33 of each K-shaped leg support member 30 is fastened securely to the top side 22 of the base member 20 near one edge, thereby forming a triangular support frame structure 40. Another two K-shaped leg support members 30 are each connected at one end to another overhead spreader bar assembly 35 such that there is an oblique angle of about sixty degrees between the second pair of support members 30. The opposite end of each support member 30 is also fastened securely to the top side 22 of the base member 20 near the edge opposite the first pair of support members 30, thereby forming another triangular support frame structure 40. The triangular support frame structures 40 are positioned perpendicular to the base member and parallel to each other. The K-shaped leg support members 30 are preferably fabricated from square tubular steel stock for strength and durability. The overhead spreader bar assemblies 35 likewise are fabricated from steel stock for strength and durability.

Figure 2:
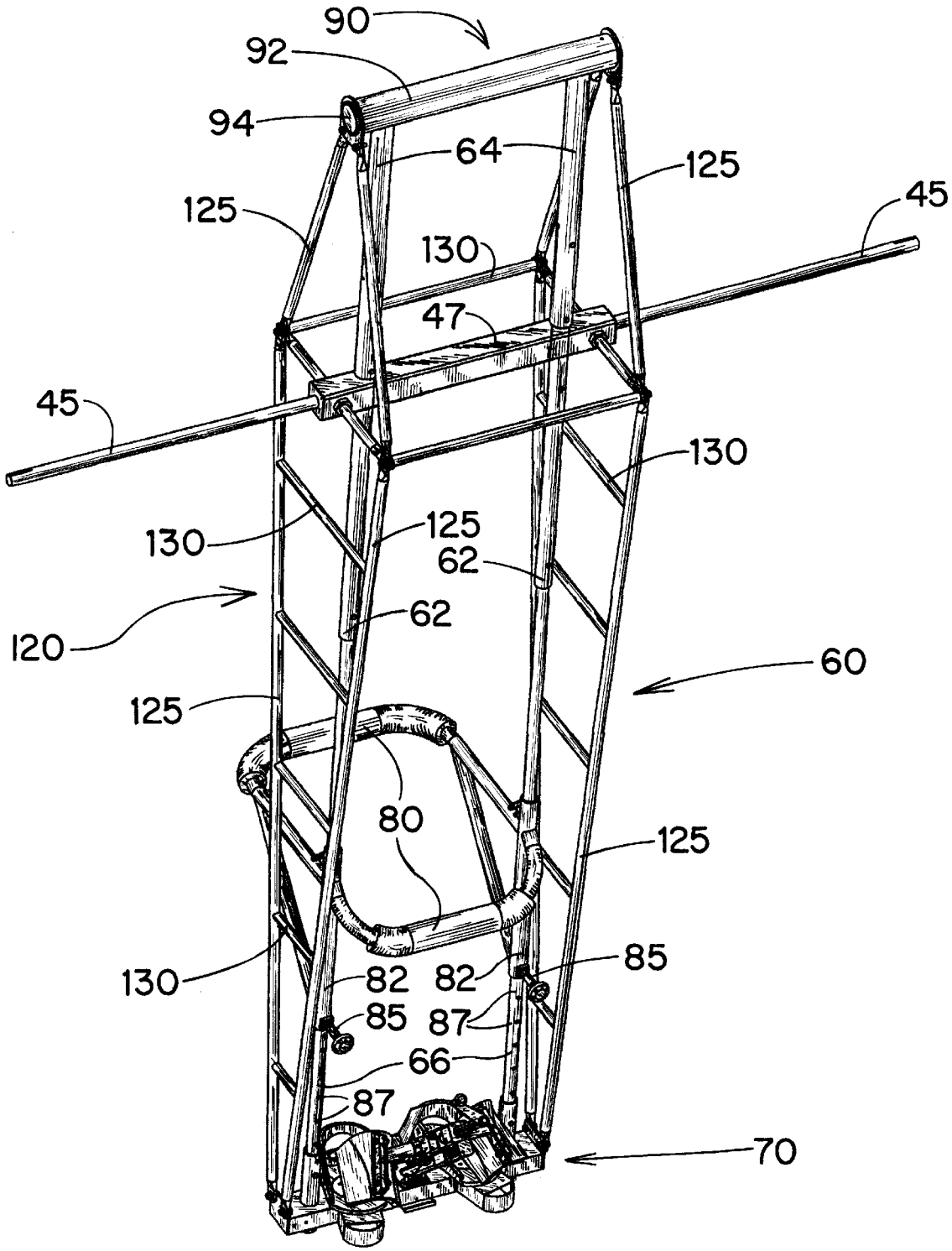
FIG. 2 is a perspective view of the swing rider carrying assembly.

A horizontal bar member 45 of circular cross section is rotatably attached between the overhead spreader bar assemblies 35 located at the top apex of each triangular support structure 40. Each overhead spreader bar assembly 35 contains two bearing members 50 in which the top horizontal bar member 45 is positioned and supported. Each bearing member 50 is contained in one of the bracket members 37 such that the horizontal bar member 45 passes through the hollow tubular member 38 of the spreader bar assembly 35. The bearing members 50 allow the top horizontal bar member 45 to rotate freely, relative to each triangular support structure 40. The horizontal bar member 45 is best seen in FIG. 2.

A rider carrying swing assembly 60 is positioned between the triangular support structures 40 and is suspended from the horizontal bar member 45. The swing assembly 60 is shown in more detail in FIG. 2. The cylindrical top horizontal bar member 45 preferably contains a rectangular center section 47 to which various components of the swing assembly 60 are attached. The rectangular center section 47 is preferably welded to the top horizontal bar member 45 for strength and durability. The swing assembly 60 contains a pair of linear swing bar members 62, rigidly attached to the rectangular center section 47 of the top horizontal bar member 45 in spaced apart relationship. Each linear swing bar member 62 has a top portion 64 which extends above the horizontal bar member 45, and a bottom portion 66 that extends below the horizontal bar member 45, but short of the base member 20. A horizontal foot support assembly 70 is secured at each end to the bottom portion 66 of each swing bar member 62, with the support assembly 70 positioned between them. The foot support bar assembly 70 is positioned a selected distance above the base member 20 and is adapted to securely fasten the feet of a rider thereto, with the rider in a standing position between the bottom portions 66 of the swing bar members 62. The linear swing bar members 62 are preferably fabricated from round tubular steel stock for strength and durability. The swing bar member top portions 64 and bottom portions 66 are preferably secured individually to the rectangular center section 47 of the horizontal bar member 45 in an opposed orientation relative to each other.

To provide additional support and protection for the rider standing on the foot support assembly 70 of the swing assembly 60, a rider encircling bracket assembly 80 is provided. The bracket member 80 is fastened with the circular portion thereof perpendicular to the linear swing bar member bottom ends 66 a selected distance above the foot support assembly 70. The rider encircling bracket member 80 is also preferably fabricated from round tubular steel stock for strength and durability. Alternatively, a high grade tubular aluminum stock may be used for the bracket member 80. The bracket member 80 is adjustable in position with the tubular vertical sections 82 concentrically positioned about the linear swing bar member bottom ends 66. A pull pin handle member 85 is positioned on each vertical section 82 with corresponding apertures 87 in the swing bar member bottom ends 66, allowing the bracket assembly 80 to be adjusted in height relative to the foot support assembly 70.

A counter weight assembly member 90 is positioned and securely fastened between the linear swing bar member top ends 64, above the horizontal bar member 45. The assembly 90 is composed of a hollow outer cylindrical member 92 within which is secured a solid cylindrical weight member 94. The counter weight assembly member 90 provides greater ease for the rider to cause the swing to rotate about the horizontal bar member 45. The counter weight assembly member 90 preferably weighs between about 60 and 100 pounds.

Additional safety railings 115 are secured between the two triangular support frame structures 40 to prevent individuals from entering the path of the rider carrying swing assembly 60 as it rotates about the top horizontal bar member 45. The safety railings are shown in FIG. 1.

The rider carrying swing assembly 60 also contains additional stability bracing members 120 to stiffen the swing assembly 60 during use. The stability bracing members 120 include vertical bracing members 125 that extend from the foot support assembly 70 to the counter weight member assembly 90, and horizontal bracing members 130 connected between the vertical bracing members 125. One stability bracing member 120 is positioned exterior each linear swing bar member 62 relative to the position of the swing rider. The stability bracing members 120 are also preferably fabricated from tubular steel stock for strength and durability.

Figure 3:
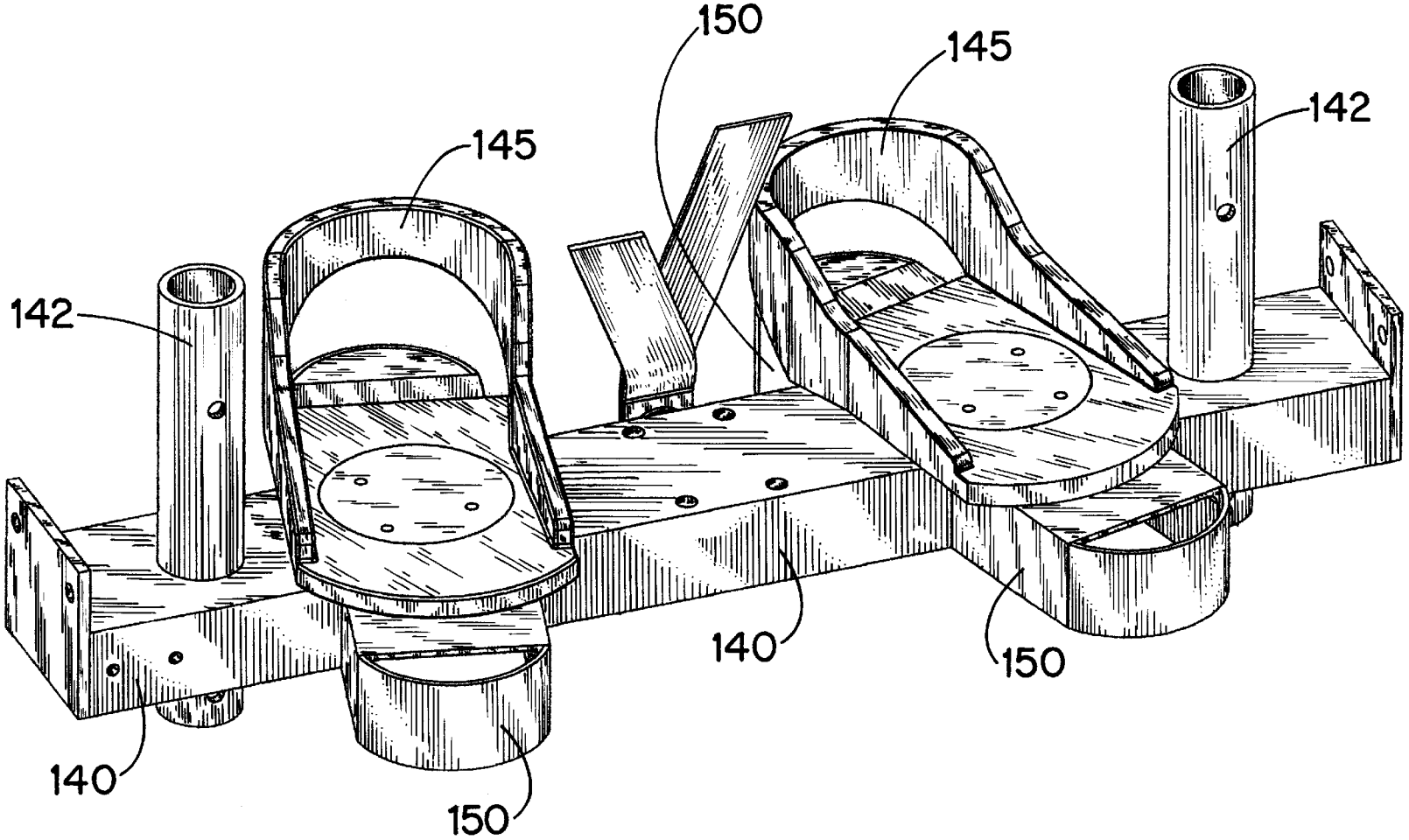
FIG. 3 is a perspective view of the swing foot support portion.

Referring now to FIG. 3, a portion of the horizontal foot support assembly 70 is shown. The foot support assembly includes a horizontal cross member 140 connected between each swing bar member bottom portion 66 by means of tubular connectors 142 fastened perpendicularly to the horizontal foot support assembly 70. The tubular connectors 142 fit concentrically about each swing bar bottom portion 66 and are secured thereto by bolts that traverse both concentric tubular parts. A pair of molded foot plates 145 are attached to the top of the horizontal cross member 140. Brace members 150 are also attached on each side of the horizontal cross member 140 to support the heel and toe portions of the foot plate members 145 that extend beyond the top surface of the cross member 140. The molded foot plates 145 are preferably mounted on the horizontal cross member 140 with the toe ends pointing slightly outwardly for the comfort of the rider.

Figure 4:
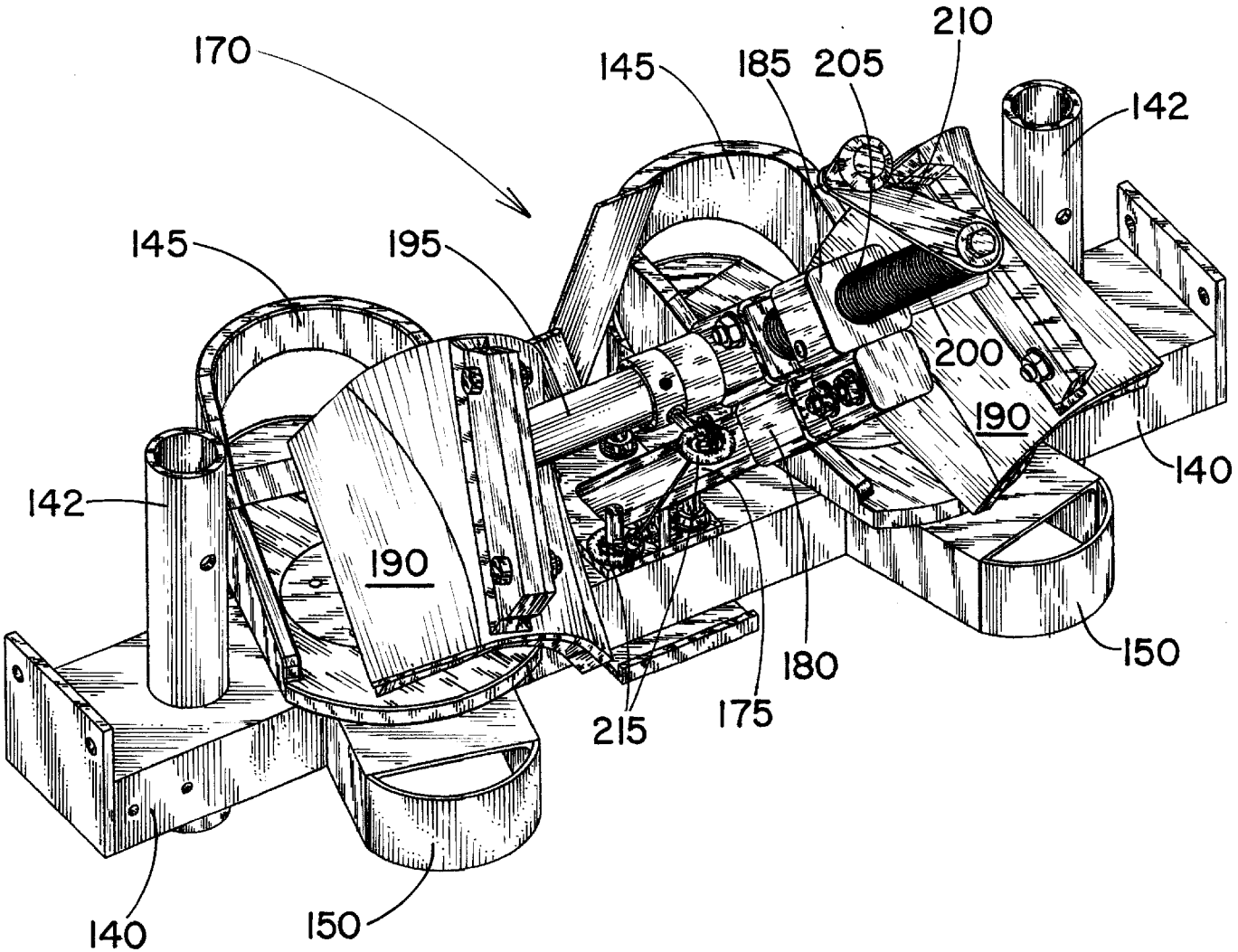
FIG. 4 is a perspective view of the clamp for the foot support portion.

The top foot clamp assembly 170 is shown in FIG. 4. A rectangular anchor bar member 175 extends forward at an upward 45 degree angle from about the center of the horizontal cross member 140. A traveling bracket member 180, capable of movement along the anchor bar member 175, is fastened thereto. The end of the anchor bar member 175 opposite the horizontal cross member 140 has a stop block member 185 attached thereto for retaining the traveling bracket member 180 thereon. A pair of top foot clamp members 190 are rotatably secured to the traveling bracket member 180 on round bar members 195 that extend perpendicularly from the bracket member 180 to position each top foot clamp member 190 over the arch of the foot of a rider standing in the foot plate members 145. The stop block member 185 has means to urge the top foot clamp assembly 170 toward the molded foot plates 145 to secure a rider's feet therein. The urging means is preferably a threaded bar member 200 passing through a like threaded aperture 205 in the stop block member 185. One end of the threaded bar member 200 contacts the traveling bracket member 180 while the opposite end of the threaded bar member 200 has a handle member 210 to rotate the threaded bar member 200 within the threaded aperture 205 in the stop block member 185. The rotation of the threaded bar member 200 quickly moves the top foot clamp assembly 170 along the anchor bar member 175 to engage or disengage a rider's feet in the foot plate members 145. The top foot clamp members 190 are preferably made of reinforced fiberglass plastic with padding on the underside for comfort to the rider. One eye bolt 215 is fastened to the horizontal cross member 140 and another eye bolt 215 is secured to the round bar member 195 which carries the top foot clamp members 190. A short length of cable 217 is fastened between the two eye bolts thereby causing the round bar member 195 and attached foot clamp member 190 to rotate outwardly as the screw handle 210 is rotated to retract the foot clamp assembly 170 from the rider's feet.

Figure 5:
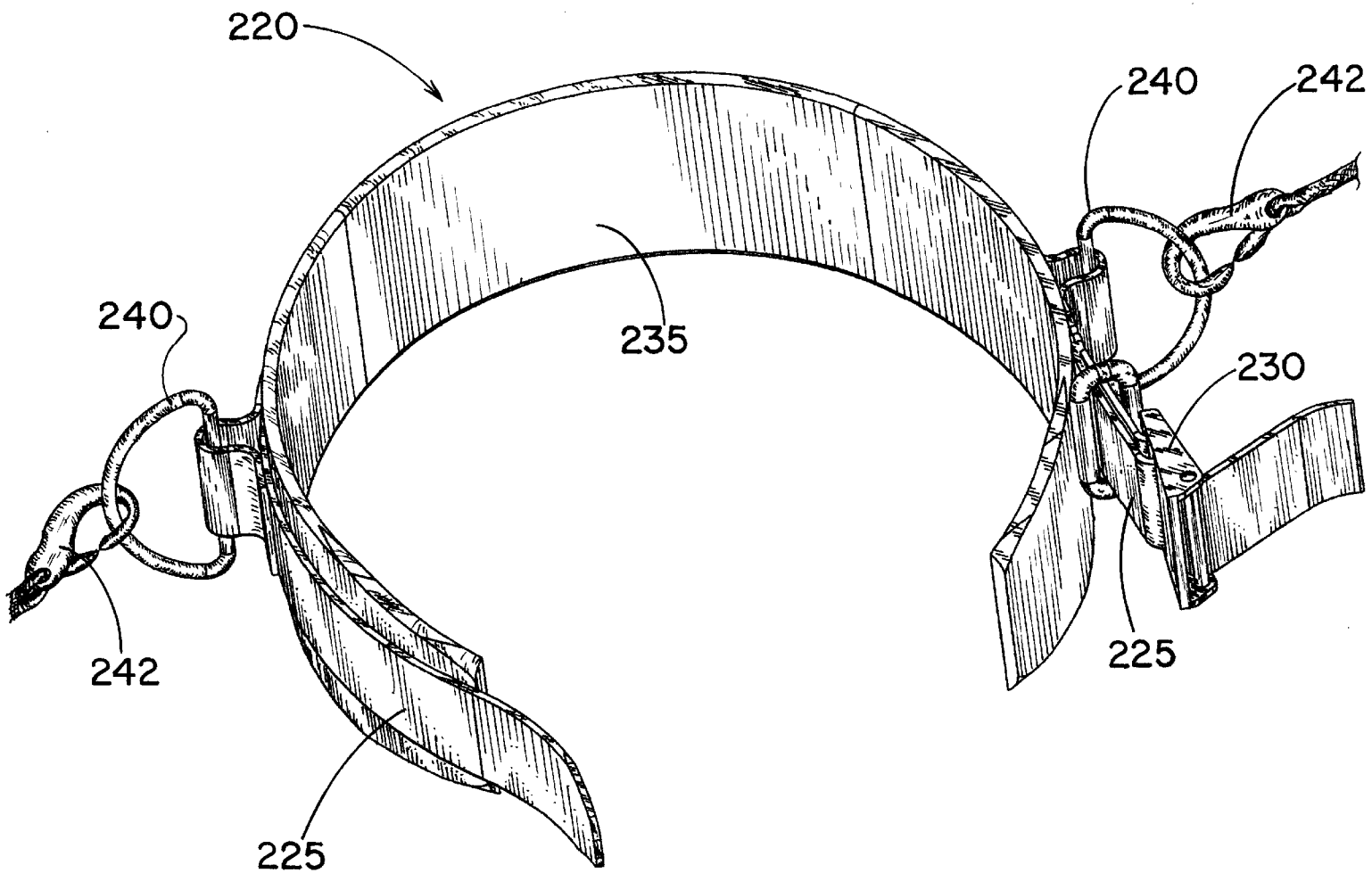
FIG. 5 is a perspective view of the safety belt member of the swing apparatus.

FIG. 5 shows the safety belt member 220 that is fastened to the swing assembly 60 to hold the rider and provide additional safety. The safety belt member 220 includes a flexible belt member 225 with a suitable belt fastener member 230 for securing the safety belt around the rider. Padding material 235 is secured to the interior side of the belt member 225 for comfort to the rider. A pair of D-ring connectors 240 are secured to the outside of the belt member 225. The D-ring connectors 240 are each connected to one of a pair of safety snap hook members 242 which are tethered to the swing assembly 60. The D-ring connectors 240 and corresponding safety snap hook members 242 are positioned at the rider's sides with the safety belt member 220 fastened around the rider's waist. The D-ring connectors 240 are permanently secured to the swing assembly 60 such that the safety belt member 220 can be readily attached around the waist of a rider standing upright in the swing assembly.

An optional anchor hook member 245, shown in FIG. 1A, is fastened to the base member 20 to hold the swing assembly 60 motionless while the rider enters or exits the swing assembly. Referring again to FIG. 1, a braking device 250 may be fastened to the horizontal bar member 45 to assist in slowing the motion of the swing assembly 60 when the swing ride is completed. The braking device 250 is preferably a disk brake assembly similar to that used in an automobile. An appropriate hydraulic cylinder mounted on the base member 20 and connecting tubing to the brake assembly on the bar member 45 constitutes a suitable braking system.

The operation of the loop swing is as follows. A rider positions one foot in each of the molded foot plates 145 and fastens the top foot clamp assembly 170 over his feet. The rider stands erect on the foot support assembly 70 and is surrounded by the encircling bracket member 80. The safety belt assembly 220 is also fastened about the waist of the rider and tethered to the encircling bracket member 80. The rider then "pumps" the loop swing apparatus causing the rider carrying swing assembly 60 to rotate about the horizontal top bar member 45. As the rider swings higher and higher, the momentum of the rotating swing assembly 60 with the rider and counter weight assembly 90 contained there upon, allows the swing assembly 60 to rotate through a full 360 degree arc. The rider is inverted, held securely by the foot clamp assembly and safety strap, as the swing assembly 60 rotates over the horizontal bar member 45. The counter weight assembly 90 assists in maintaining the momentum of the swing assembly 60 and rider, as the rider pumps the swing assembly 60 in a full 360 degree arc.

Further, it may be desirable to have a means of assisting the rider in starting the swinging motion of the swing assembly 60. This can be accomplished by the use of a cable, connected to the swing assembly 60 with a release hook, with the cable drawing the swing assembly 60 and rider therein, to nearly a nearly vertical inverted orientation. The hook then releases the swing assembly to begin the swinging motion.

While the invention has been particularly shown and described with reference to a preferred embodiment thereof, it will be understood by those skilled in the art that various changes in form and details may be made therein without departing from the spirit and scope of the invention.

I claim:

1. A portable swing apparatus for allowing an individual to safely perform forward or backward loops while in a standing position comprising;

a) a horizontal flat base member having top and bottom sides;

b) a pair of triangular support frame structures positioned atop said base member and near opposite edges thereof, c) a top horizontal bar member rotatably attached between said triangular support frame structures, said top bar member rotating within bearing members contained in each of said support frame structures;

d) a rider carrying swing assembly positioned between said triangular support frame structures comprising;

e) a pair of linear swing bar members rigidly attached to said top horizontal bar member, each of said swing bar members having a top portion extending a selected distance above said horizontal bar member and a bottom portion extending a selected distance below said horizontal bar member;

f) a horizontal foot support assembly secured at each end to one of said swing bar members bottom portion and positioned there between, said foot support assembly positioned a selected distance above said base member and adapted to securely fasten a rider's feet thereto;

g) a rider encircling bracket member positioned between said swing bar members and attached thereto, said encircling bracket member located a selected distance above said foot support member; and h) a counter weight assembly member positioned between said swing bar member top potions and attached there between;

i) whereby a rider, positioned in a standing position with feet secured by said foot support assembly and torso encircled by said encircling bracket member, causes the swing assembly to move to and fro by rhythmic body movements thereby causing said swing assembly with the rider thereon to loop around said rotatable horizontal bar member.

2. The portable swing apparatus of claim 1 wherein said triangular support frame structures comprise pairs of K-shaped leg support members each connected at one end to an overhead spreader bar assembly and at an opposite end to spaced apart locations on said base member top side to form said triangular support frame structure, each thereon.

3. The portable swing apparatus of claim 2 wherein said bearing members are contained in said overhead spreader bar assembly.

4. The portable swing apparatus of claim 1 wherein said horizontal foot support assembly comprises a horizontal cross member attached at each end to a swing bar member bottom end, a pair of molded foot plates fastened atop said cross member, and a foot clamp assembly positioned to securely fasten a rider's feet positioned in said molded foot plates.

5. The portable swing apparatus of claim 4 wherein said foot clamp assembly comprises an anchor bar member fastened at an upward angle atop said horizontal cross member and positioned between said pair of molded foot plates attached thereto, a traveling bracket member moveable along said anchor bar member, a stop block member for retaining said traveling bracket member on said anchor bar member, a pair of top foot clamp members rotatably attached to said traveling bracket member and each of said top foot clamp members positioned above one of said foot plates, and means to urge the top foot clamp members toward the foot plates to secure a rider's feet therein.

6. The portable swing apparatus of claim 5 wherein said means to urge the top foot clam members toward the foot plates comprises a threaded bar member with handle attached thereto, said bar member positioned within a threaded aperture in said stop block member, whereby said threaded bar member is rotated by said handle member, thus moving said top foot clamp members relative to said foot plates.

7. The portable swing apparatus of claim 1 further comprising a safety belt member secured between said pair of linear swing bar members and positioned for reversibly fastening about a rider's torso.

8. The portable swing apparatus of claim 1 wherein said rider encircling bracket member is attached to said swing bar members by a pair of vertical tube members, each of said vertical tube members positioned concentrically about one linear swing bar member and adjustably fastened thereto.

9. The portable swing apparatus of claim 8 further comprising a pair of push pin handle members one secured perpendicularly to each of said vertical tube members of said rider encircling bracket member, said push pin handle members adapted to engage one of a plurality of apertures in each linear swing bar member bottom portion, thereby providing a change in the selected distance of said rider encircling bracket member above said foot support member.

10. A portable swing apparatus for allowing an individual to safely perform forward or backward loops while in a standing position comprising;

a) a horizontal flat base member having top and bottom sides;

b) first and second pairs of K-shaped leg support members, said first pair of support members each connected at one end to an overhead spreader bar assembly and at an opposite end to spaced apart locations on said base member top side to form a triangular support frame structure thereon, said second pair of support members each connected at one end to another overhead spreader bar assembly and at an opposite end to spaced apart locations on said base member top side to form another triangular support frame structure thereon, said triangular support frame structures positioned near opposite edges of said base member;

c) a top horizontal bar member rotatably attached between said overhead spreader bar assemblies of said triangular support frame structures, said top bar member rotating within bearing members contained in each overhead spreader bar assembly;

d) a rider carrying swing assembly positioned between said triangular support frame structures comprising;

e) a pair of linear swing bar member rigidly attached to said top horizontal bar member, each of said swing bar members having a top portion extending a selected distance above said horizontal bar member and a bottom portion extending a selected distance below said horizontal bar member;

f) a horizontal foot support assembly secured at each end to one of said swing bar members bottom portion and positioned there between, said foot support assembly positioned a selected distance above said base member and adapted to securely fasten a rider's feet thereto;

g) a rider encircling bracket member positioned between said swing bar members and attached thereto, said encircling bracket member located a selected distance above said foot support member; and h) a counter weight assembly member positioned between said swing bar member top portions and attached there between;

i) whereby a rider, positioned in a standing position with feet secured by said foot support assembly and torso encircled by said encircling bracket member, causes the swing assembly to move to and fro by rhythmic body movements thereby causing said swing assembly with the rider thereon to loop around said rotatable horizontal bar member.

11. The portable swing apparatus of claim 10 wherein said overhead spreader bar assembly comprises a pair of overhead bracket members with a hollow tubular member fastened there between, said overhead bracket members each securing one top leg of said pair of K-shaped leg support members, with said bearing member contained in each bracket member.

12. The portable swing apparatus of claim 10 wherein said horizontal foot support assembly comprises a horizontal cross member attached at each end to a swing bar member bottom end, a pair of molded foot plates fastened atop said cross member, and a foot clamp assembly positioned to securely fasten a rider's feet positioned in said molded foot plates.

13. The portable swing apparatus of claim 12 wherein said foot clamp assembly comprises an anchor bar member fastened at an upward angle atop said horizontal cross member and positioned between said pair of molded foot plates attached thereto, a traveling bracket member moveable along said anchor bar member, a stop block member for retaining said traveling bracket member on said anchor bar member, a pair of top foot clamp members rotatably attached to said traveling bracket member and each of said top foot clamp members positioned above one of said foot plates, and means to urge the top foot clamp members toward the foot plates to secure a rider's feet therein.

14. The portable swing apparatus of claim 13 wherein said means to urge the top foot clam members toward the foot plates comprises a threaded bar member with handle attached thereto, said bar member positioned within a threaded aperture in said stop block member, whereby said threaded bar member is rotated by said handle member, thus moving said top foot clamp members relative to said foot plates.

15. The portable swing apparatus of claim 10 further comprising a safety belt member secured between said pair of linear swing bar members and positioned for reversibly fastening about a rider's torso.

16. The portable swing apparatus of claim 10 wherein said rider encircling bracket member is attached to said swing bar members by a pair of vertical tube members, each positioned concentrically about one linear swing bar member and adjustably fastened thereto.

17. The portable swing apparatus of claim 16 further comprising a pair of push pin handle members one secured perpendicularly to each vertical tube member of said rider encircling bracket member, said push pin handle members adapted to engage one of a plurality of apertures in each linear swing bar member bottom portion, thereby providing a change in the selected distance of said rider encircling bracket member above said foot support member.

18. The portable swing apparatus of claim 10 further comprising safety rail members attached to said swing assembly to prevent individuals from entering the path of the rider carrying swing assembly as it rotates about the top horizontal bar member.

19. A portable swing apparatus for allowing an individual to safely perform forward or backward loops while in a standing position comprising;

a) a horizontal flat base member having top and bottom sides;

b) first and second pairs of K-shaped leg support members, said first pair of support members each connected at one end to an overhead spreader bar assembly and at an opposite end to spaced apart locations on said base member top side to form a triangular support frame structure thereon, said second pair of support members each connected at one end to another overhead spreader bar assembly and at an opposite end to spaced apart locations on said base member top side to form another triangular support frame structure thereon, said triangular support frame structures positioned near opposite edges of said base member;

c) a top horizontal bar member rotatably attached between said overhead spreader bar assemblies of said triangular support frame structures, said top bar member rotating within bearing members contained in each overhead spreader bar assembly;

d) a rider carrying swing assembly positioned between said triangular support frame structures comprising;

e) a pair of linear swing bar members rigidly attached to said top horizontal bar member, each swing bar member having a top portion extending a selected distance above said bar member and a bottom portion extending a selected distance below said bar member;

f) a pair of linear swing bar members rigidly attached to said top horizontal bar member, each of said swing bar members having a top portion extending a selected distance above said horizontal bar member and a bottom portion extending a selected distance below said horizontal bar member;

g) a horizontal foot support assembly secured at each end to one of said swing bar members bottom portion and positioned there between, said foot support assembly positioned a selected distance above said base member and adapted to securely fasten a rider's feet thereto;

h) a rider encircling adjustable bracket member positioned between said swing bar members and attached thereto, said encircling bracket member located a selected distance above said foot support member;

i) a safety belt member secured between said pair of linear swing bar members and positioned for reversibly fastening about a rider's torso; and j) a counter weight member positioned between said swing bar member top portions and attached there between;

k) whereby a rider, positioned in a standing position with feet secured by said foot support assembly and torso encircled by said encircling bracket member, causes the swing assembly to move to and fro by rhythmic body movements thereby causing said swing assembly with the rider thereon to loop around said rotatable horizontal bar member.

20. The portable swing apparatus of claim 1 further comprising safety rail members attached to said swing assembly to prevent individuals from entering the path of the rider carrying swing assembly as it rotates about the top horizontal bar member.

* * * * *